United States Patent [19]

Brooks

[11] 3,970,288

[45] July 20, 1976

[54] METERING DEVICE AND MIXING APPARATUS

[76] Inventor: Frank Brooks, 11, Lansdowne Road, Atherton, near Manchester, England

[22] Filed: Jan. 24, 1975

[21] Appl. No.: 543,743

Related U.S. Application Data

[63] Continuation-in-part of Ser. No. 407,032, Oct. 16, 1972, Pat. No. 3,887,168.

[52] U.S. Cl. ..... 259/7; 222/218

[51] Int. Cl.[2] ..... B01F 15/02

[58] Field of Search ..... 259/18, 14, 15, 16, 259/30, 31, 32, 57, 58, 82, 84, 85, 3, 154, 148, DIG. 20, 25, 7, 8, 5, 6; 222/218, 219

[56] References Cited

UNITED STATES PATENTS

| | | | |
|---|---|---|---|
| 709,793 | 9/1902 | McGinnity | 222/218 |
| 2,684,186 | 7/1954 | Mattos | 222/218 |
| 3,353,722 | 11/1967 | Mehta | 222/218 |

*Primary Examiner*—Robert W. Jenkins

*Attorney, Agent, or Firm*—Caesar, Rivise, Bernstein & Cohen, Ltd.

[57] ABSTRACT

The invention relates in the first instance to apparatus for dispensing granular material, for example plastics granules dosed with a coloring agent. Granular material and the coloring agent are located in supply hoppers and metering means feed predetermined metered quantities to a mixing device which supplies the dosed material to a supply hopper. The apparatus is arranged to operate when the level of dosed material in the supply hopper falls below a predetermined level, whereupon actuation of the metering means causes automatic replenishment to that level.

In a second embodiment of the invention there is provided a shroud, such that the materials are discharged within the shroud to contact a mixer blade and then fed to the injection molding machine.

The invention also contemplates a metering device including a cylinder with an opening in its wall to communicate with a measuring chamber located within the body of the cylinder. A rod passing through the back wall of the measuring chamber is connected to a head within the chamber. One end of the rod is contacted by a crank arm within the cylinder such that rotation of the cylinder causes movement of the rod head axially within the measuring chamber.

8 Claims, 9 Drawing Figures

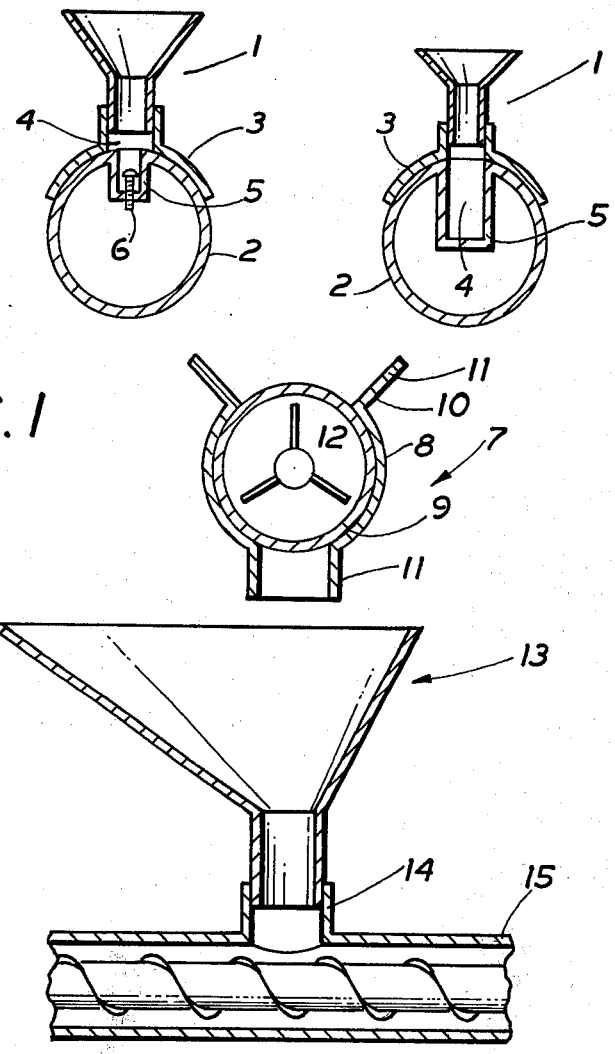
FIG. 1
FIG. 2
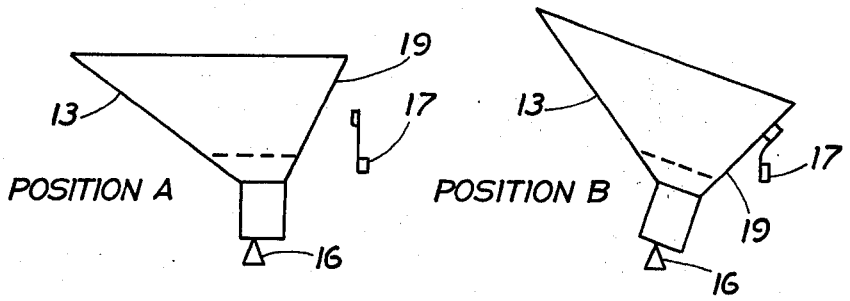

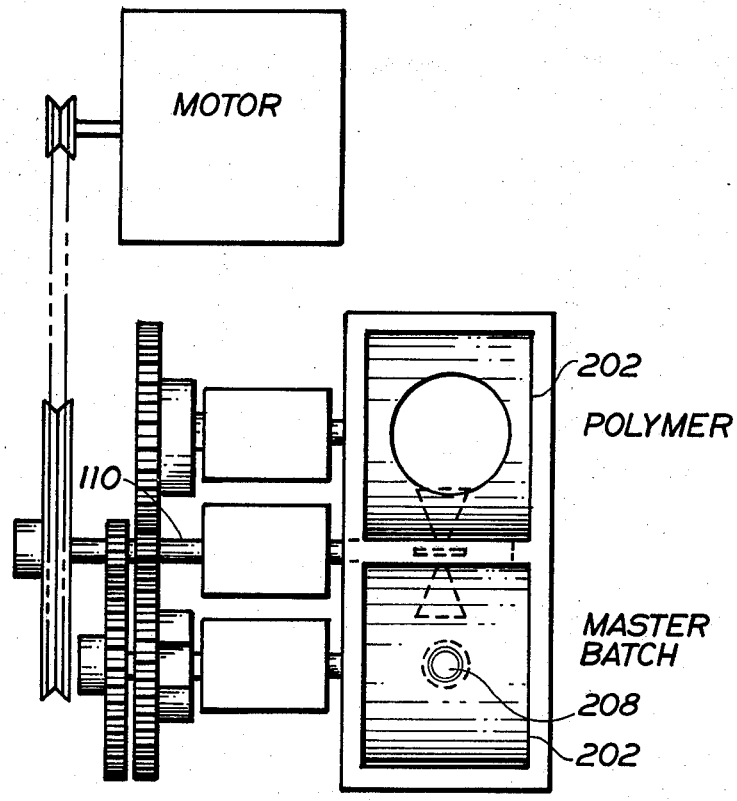
FIG. 9
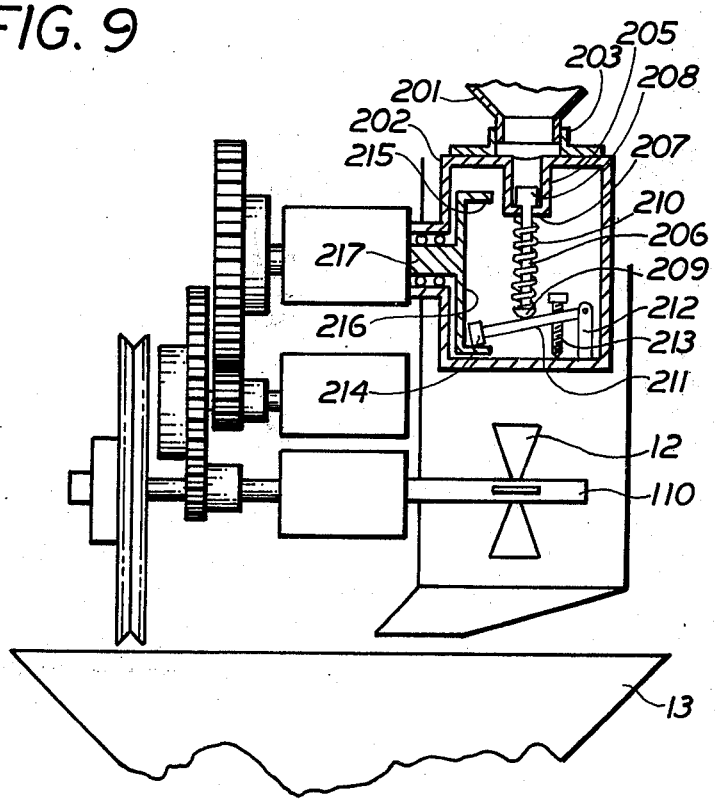

METERING DEVICE AND MIXING APPARATUS

This application is a continuation-in-part application based on copending United States application Ser. No. 407,032 filed Oct. 16, 1972, now U.S. Pat. No. 3,887,168.

The invention relates to mixing of materials, for example, proportioning of a small quantity of one material into a proportioned major quantity of one or more other materials.

It is an object of the invention to provide apparatus for such mixing which apparatus is of relatively cheap construction and which will have a relatively long maintenance free working life.

According to the invention, there is provided:

an apparatus for delivering to a receiver a mixture in predetermined proportions of particulate materials, comprising:

a source of each of the materials;

a mixing device;

metering means adapted at each actuation thereof to feed a measured quantity of each material from the respective source to the mixing device;

the mixing device comprising a cylinder and a rotary mixer blade therein, the cylinder having an opening in its wall and being rotatable about its axis between a first position in which the opening is disposed to receive the measured quantities of materials from the metering means and a second position in which the opening is disposed to deliver the materials to the receiver;

and drive means for actuating the metering means, for moving the cylinder of the mixing device from its first to its second position, and for rotating the mixer blade during such movement.

The invention further relates to mixing of materials, for example, proportioning of a small quantity of one material into a proportional major quantity of one or more other materials.

According to the invention, apparatus for delivering to a receiver a mixture in predetermined proportions of particulate materials, comprises for combination with a source of each of the materials, a mixing blade; metering means adapted at each actuation thereof to feed a measured quantity of each material from the respective source towards the mixing blade and drive means for actuating the metering means and rotating the mixing blade, the metering means and the mixing blade being housed in a shroud having an outlet adjacent the mixing blade and located above the receiver, the receiver being arranged to tip about a horizontal axis and being so asymmetrically shaped about the vertical plane through that axis that it will tip in one direction when the level of material therein falls sufficiently and in the reverse direction when the level rises sufficiently; the tipping movements of the receiver being arranged to cause energisation and de-energisation respectively of the drive means.

Preferably the parts are so disposed that the materials can flow by gravity from the sources to the metering means, thence onto the mixing device and then to the receiver.

The invention still further relates to a metering device for use in dispensing small doses of particulate material.

A metering device according the the invention, comprises a cylinder having an opening in its wall communicating with a measuring chamber located within the body of the cylinder, a rod passing through the back wall of the chamber and connected to a head within the chamber, the other end of the rod being in contact with a crank arm within the cylinder such that rotation of the cylinder about its axis causes movement of the rod head axially of the measuring chamber.

Preferably the rod is of adjustable length so that the amount of material metered by the device may be adjusted.

An embodiment of the invention is illustrated by the accompanying diagramatic drawings in which:

FIG. 1 is a sectional elevation of one form of apparatus in accordance with the invention;

FIG. 2 shows in two alternative operating positions part of the apparatus shown in FIG. 1 and FIGS. 3 and 4 show parts of the apparatus of FIG. 1 in different positions of operation.

FIG. 9 is a view showing the drive means for actuating the metering device.

Figure 3:
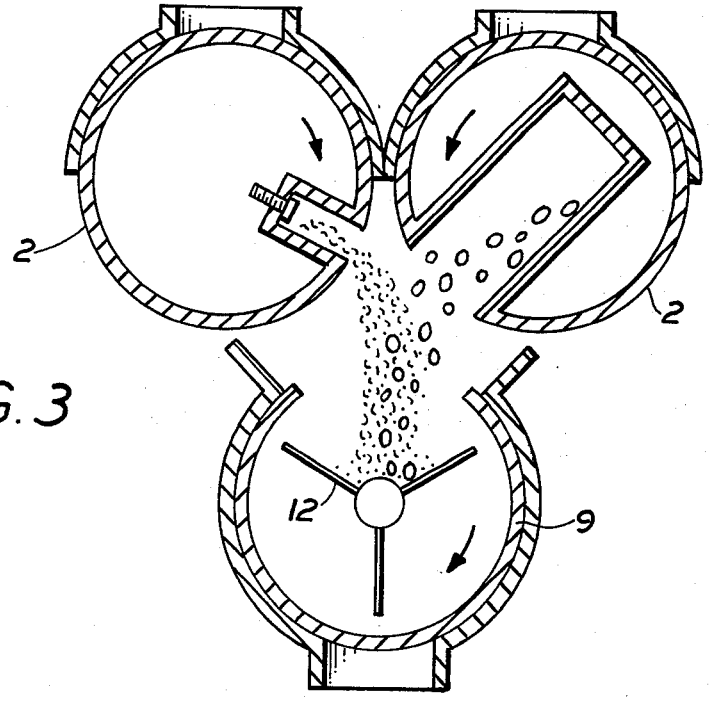

The apparatus of FIG. 1 includes two side-by-side supply hoppers 1, constituting sources of two particulate materials. A metering device is located below each hopper 1, and comprises a rotary cylinder 2 and associated stator flanges 3. Each cylinder has an opening 4 in its wall and the opening communicates with a measuring chamber 5. Preferably at least one of the chambers 5 is of adjustable volume, conveniently by means of an adjustable screw 6, as shown for the left hand chamber.

A mixer 7 is mounted below the metering devices. The mixer comprises a stationary cylindrical housing 8 in which fits a rotatable cylinder 9. The housing 8 is formed with openings and flanges which define an inlet 10 and an outlet 11. The cylinder 9 has a longitudinal slot in its wall and a rotary mixing blade 12 is mounted coaxially within it.

A receiver 13 is mounted below the mixer 7 and is connected to the inlet 14 of an injection molding machine 15.

The receiver 13 is mounted on a fulcrum 16 (FIG. 2), so that it can pivot between the two positions A and B shown in FIG. 2. The receiver is so asymmetrically shaped about the vertical plane through its pivot axis that it will tip from position A to position B when the level of the material therein falls sufficiently. A microswitch 17, located in the path of movement of the receiver 13, is adapted to make or break a circuit controlling drive means for the metering devices and the mixer 7.

Figure 4:
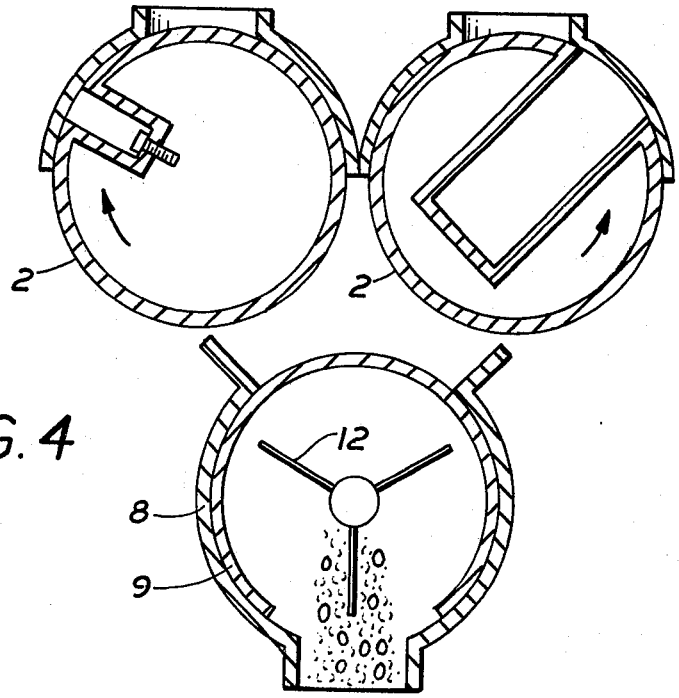

When the drive means are in operation the cylinders 2 are rotated so that during each revolution chambers 5 are first filled with materials by gravity flow from the respective hoppers 1 (FIG. 1) and then discharge such materials by gravity into the mixer 7 below (FIG. 3). Cylinder 9 is rotated synchronously with the cylinders 2 and is positioned with the slot therein uppermost when the material is discharged by the cylinder 2, so that the material directly enters the cylinder 9. During the subsequent part of the revolution the mixing blade 12 is rotated (at a speed faster than that of cylinder 9) so that by the time the slot is directed downwards (FIG. 4) the materials are adequately mixed. The mixed materials are then discharged by gravity into the receiver 13, from which the mixed materials flow into the inlet 14 of the injection molding machine 15.

When the receiver 13 contains more than a predetermined minimum quantity of the materials, it is in position A, so that the drive means are not energized and the metering devices and the mixer 7 are stationary; when the contents of the receiver fall to the predetermined minimum the changed position of the center of gravity causes the receiver 13 to move from position A to position B and this movement actuates the microswitch 17 to complete a circuit for energizing the drive means of the metering devices and the mixer 7. A fresh supply of premixed material is then delivered to the receiver 13 until the quantity of material therein rises to a predetermined maximum, whereupon the changed position of the center of gravity causes it to move from position B to position A and this actuates the microswitch 17 to break the circuit and de-energize the drive means.

In a preferred use, the materials are plastics powders and/or granules dosed with a coloring agent, the coloring agent being in one supply hopper and the plastics material in another.

Figure 5:
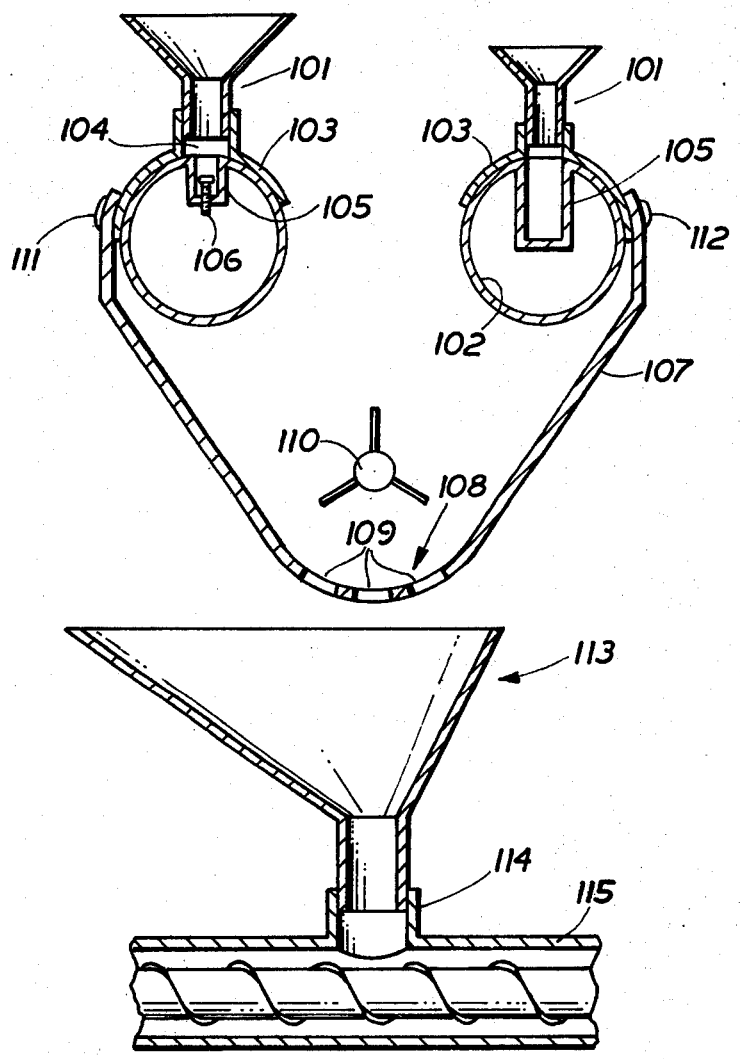
FIG. 5 is a sectional elevation of one form of apparatus in accordance with the invention.

The apparatus of FIG. 5 includes two side-by-side supply hoppers 101, constituting sources of two particulate materials. A metering device is located below each hopper 101, and comprises a rotary cylinder 102 and associated stator flanges 103. Each cylinder has an opening 104 in its wall and the opening communicates with a measuring chamber 105. Preferably at least one of the chambers 105 is of adjustable volume say between 0.5 to 2.5 ml, the adjustment being by means of an adjustable hammer 106, as shown for the left hand chamber. The chamber 105 of adjustable volume is most preferably as described in our copending application for Letters Patent Ser. No. 407,032.

A shroud 107, conveniently of sheet metal and of generally U-crossectional shape extends from the supply hoppers and below the metering devices. The bight 108 of the shroud 107 has some slots 109. Immediately above the slots 109 is a rotary mixing blade 110. The shroud 107 is connected by bolts 111, 112 in releasable manner to the hopper flanges 103.

A receiver 113 is mounted below the slots 109 and is connected to the inlet 114 of an injection moulding machine 115. See FIG. 2 for the pivoting of receiver 113 (13 in FIG. 2) between positions A and B as previously described.

When the drive means are in operation the cylinders 102 are rotated so that during each revolution chambers 105 are first filled with materials by gravity flow from the respective hoppers 101 (FIG. 5) and then discharge such materials by gravity onto the mixer blade 110 below within the shroud 107. The blade 110 is rotated synchronously with the cylinder 102 and during its rotation it mixes up the materials falling from the hoppers 101 and brings them to the slots 109. The mixing materials are then discharged by gravity through the slots 109, into the receiver 113, from which the mixed materials flow into the inlet 114 of the injection moulding machine 115.

When the receiver 113 contains more than a predetermined minimum quantity of the materials, it is in position A of FIG. 2, so that the drive means are not energised and the metering devices and the mixer blade 110 are stationary; when the contents of the receiver fall to the predetermined minimum the changed position of the center of gravity causes the receiver 113 (13 in FIG. 2) to move from position A to position B and this movement actuates the microswitch 117 (17 in FIG. 2) to complete a circuit for energizing the drive means of the metering devices and the mixer. A fresh supply of premixed material is then delivered to the receiver 113 (13 of FIG. 2) until the quantity of material therein rises to a predetermined maximum, whereupon the changed position of the center of gravity causes it to move from position B to position A and this actuates the microswitch 117 (17 in FIG. 2) to break the circuit and de-energize the drive means.

In a preferred use, the materials are plastics powders and/or granules dosed with a coloring agent, the coloring agent being in the supply hopper having the adjustable screw and the plastics material in another.

Figure 6:
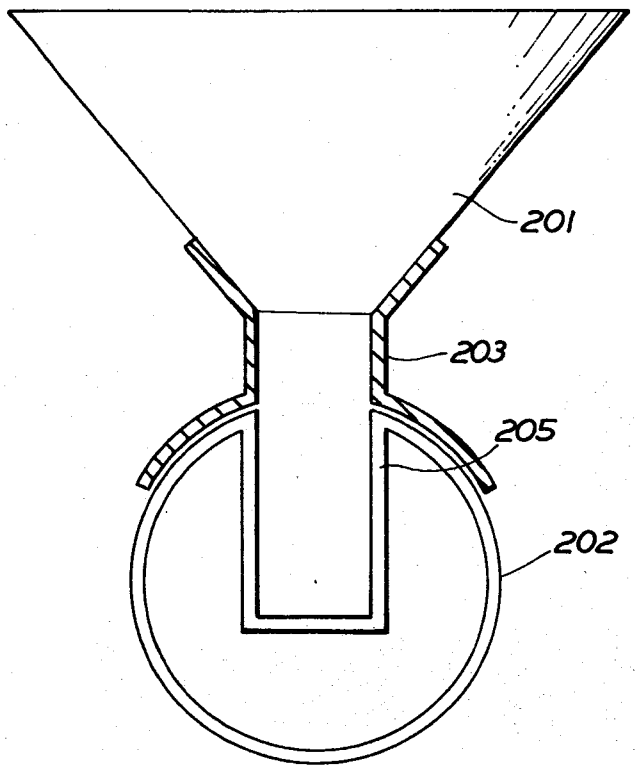
FIG. 6 is a sectional elevation of a mixing apparatus incorporating a metering device of the invention.
Figure 6:
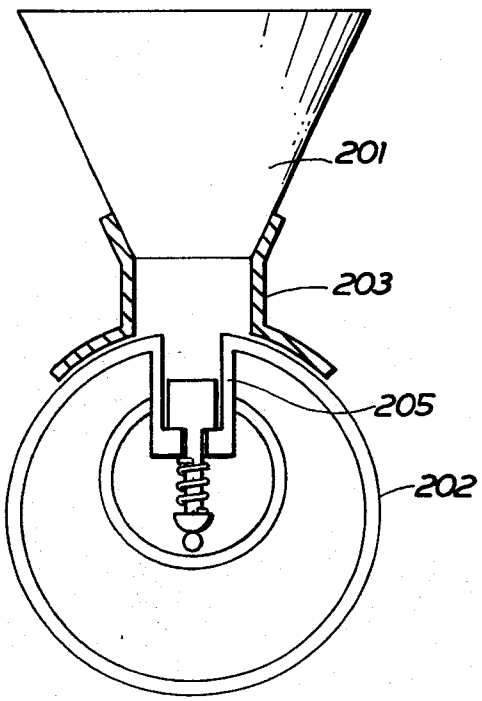

The apparatus of FIG. 6 includes two side-by-side hoppers 201, constituting sources of two particulate materials. A metering system is located below each hopper 201, and comprises a rotary cylinder 202 and associated stator flanges 203. Each cylinder has an opening 204 in its wall and the opening communicates with a measuring chamber 205. One of the chambers 205, the left hand one as shown is of adjustable volume and is arranged to dispense say a colorant to a plastics granular material dispensed by the other of the chambers. The left hand chamber 205 is the metering device of the invention and is more particularly shown in FIGS. 7 and 8.

In the case of the left hand chamber 205, a rod 206 extends through a hole in the back wall 207 of the chamber 205. The rod 206 is connected at the end within the chamber 205 to a head 208 dimensioned such that there is little annular clearance between the head and the inner wall of the chamber. The other end of the rod is expanded to form a head 209. The rod 206 is formed of two telescopic sections, so that its length can be adjusted or it may have a screw threaded end portion to be received in a hole in the back of the head 208, for the same effect.

One end of an arm 211 is pivotally fixed to a post 212 extending inwardly of the cylinder 212 from a portion of the wall radially opposite but longitudinally displaced from the chamber 205. A screw 213 extends through the arm 211 towards the cylinder wall adjacent the post 212. The other end of the arm 211 is connected to a head 214 which travels within the peripheral wall or raceway 215 of a disc 216. The disc is secured to the end of a static cam 217 passing through a hole in the back of the cylinder 202 at a position displaced from the center of the disc 216, so dividing it into two portions of different radii.

Figure 7:
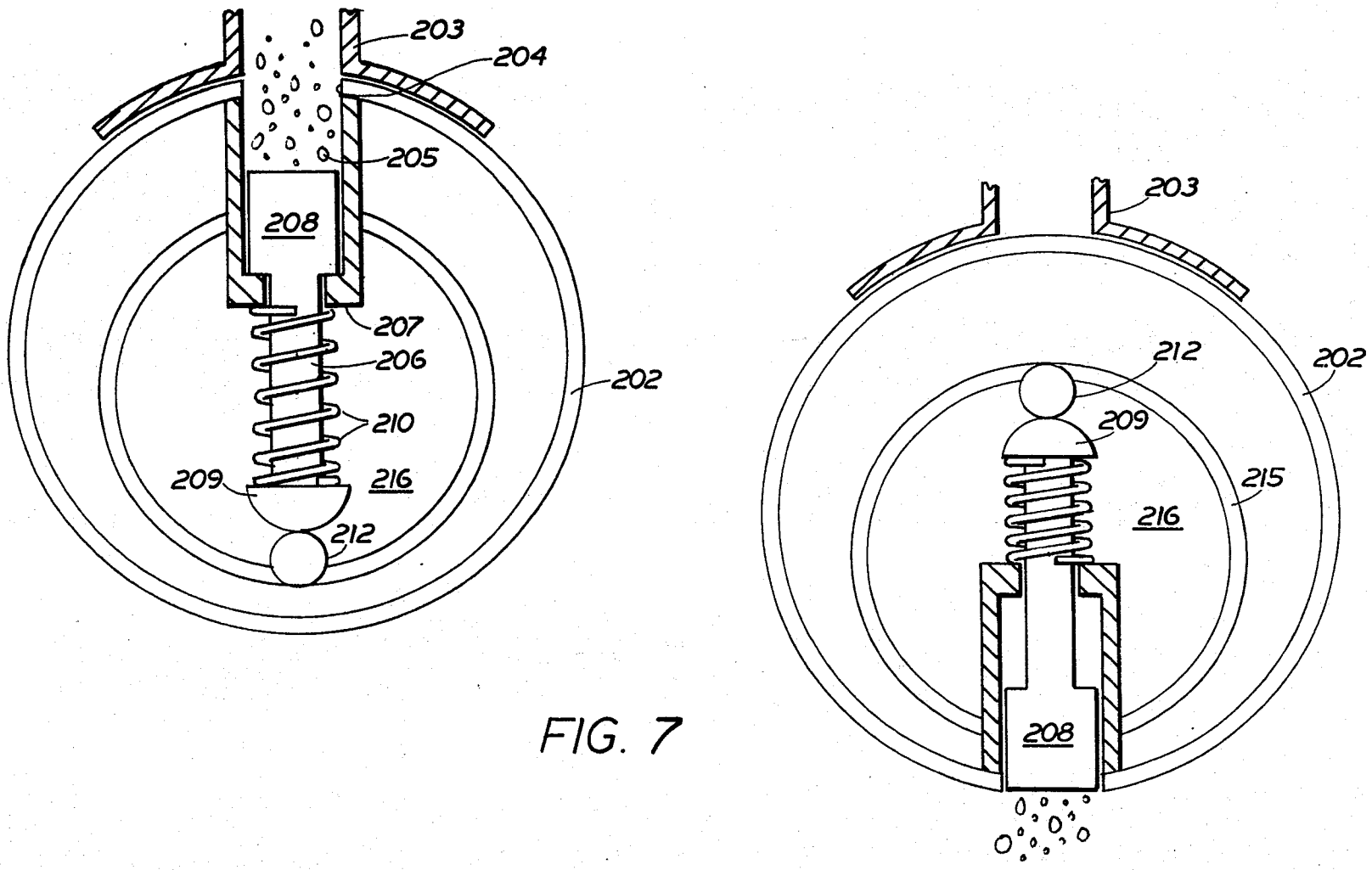
FIGS. 7 and 8 are respectively elevational and longitudinal sectional views of the metering device of FIG. 1 each showing first feeding of material into the measuring chamber and second discharge of material therefrom.
Figure 8:
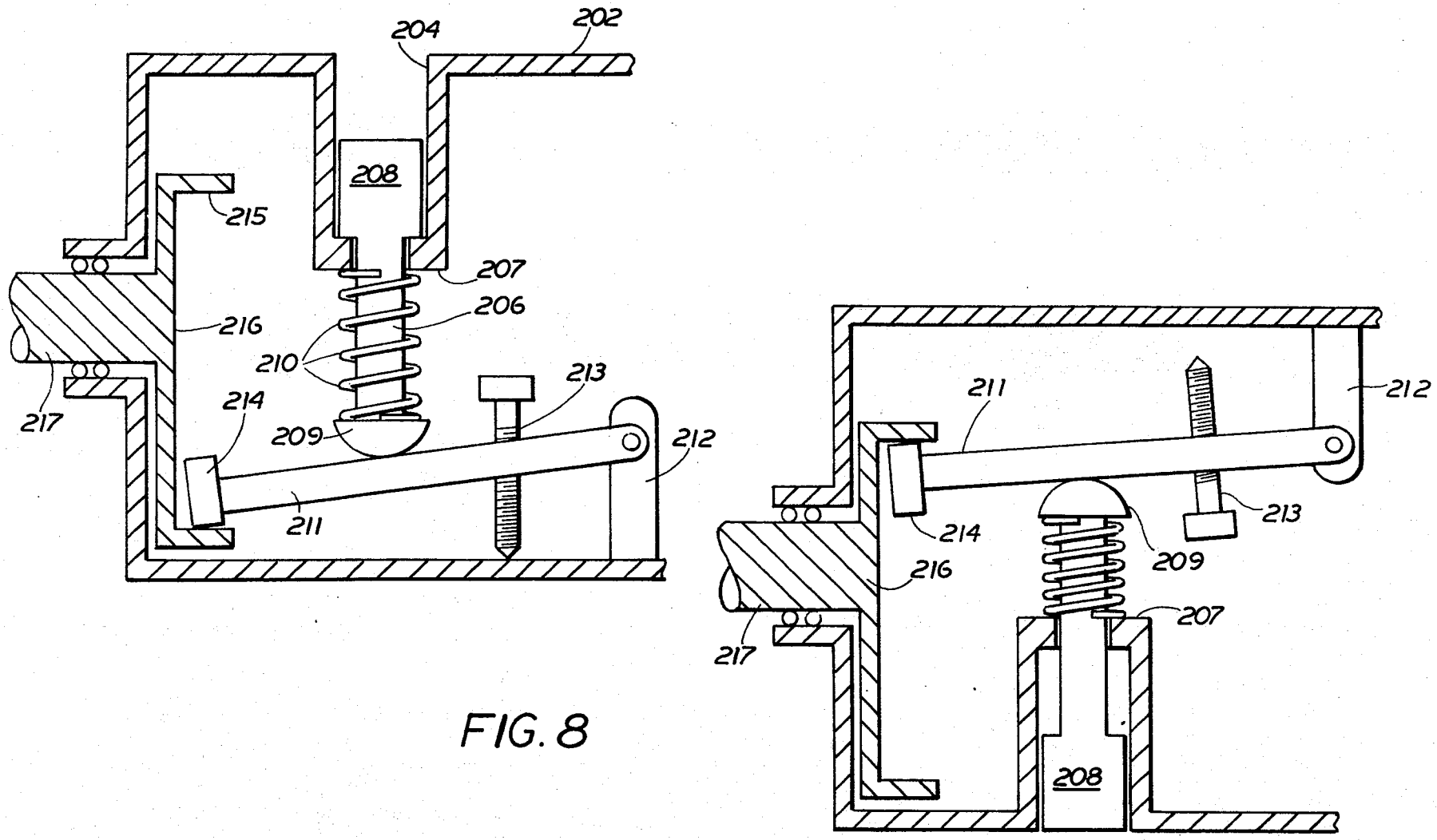

The cylinder 202 is arranged to rotate by drive means, not shown, while the disc 216 is held stationary on its cam 217. As the cylinder rotates the measuring chamber 205 is brought to a top dead center position and below the outlet of the respective supply hopper 201 (FIG. 7). Material falls into the chamber 205 by gravity, the volume of material received depending on the position of the rod head 208. As the cylinder continues to rotate, the centrifugal force tends to urge the arm head 214 to rotate within the disc 216 against the force of the spring 210. Continued rotation brings the chamber 205 to a bottom dead center position, allowing material to exit through the outlet 204 by gravity.

The off center mounting of the disc 216 causes compression of the spring 210 to urge the rod 206 to move axially within the chamber towards the outlet 204. The resultant movement of the rod head 208 through the chamber 205 ensures that all (or substantially all) of the material therein is forced out of the chamber, so ensuring that the measured volume of material received by the chamber 205 from the hopper 201 is passed on to the next operation. Continued rotation of the cylinder 202 causes the arm head 214 to move back to the condition of FIG. 7, and the cycle is then repeated. Adjustment of the screw 213 alters the metering stroke and hence the amount of material metered by the device.

The stator flange 203 may be extended downwardly to define a wiping blade, not shown, and this is especially useful where the particulate material is a hot or sticky plastic powder.

Using the metering device of the invention it is possible to meter materials in volumes 0.5 to 2.5 ml to a high degree of accuracy on a reliable basis.

Without further elaboration, the foregoing will so fully illustrate my invention that others may, by applying current or future knowledge, readily adapt the same for use under various conditions of service.

What is claimed as the invention is:

1. Apparatus for delivering to a receiver a mixture in predetermined proportions of particulate materials, comprising:

a source of each of the materials;

a shroud positioned below each source;

metering means interposed between the source and the shroud and adapted at each actuation of the metering means to feed a measured quantity of each materal from the respective source to the shroud;

the shroud serving to house mixing means, such that the feeding of material by said metering means is into said mixing means which rotates synchronously with the feeding motion of said metering means, said shroud also having discharge slots, such that said materials are discharged to a receiver;

and drive means for actuating the metering means, and for rotating the mixer means.

2. Apparatus according to claim 1, in which the metering means comprises for each of the materials a cylinder having in its wall an opening communicating with a measuring chamber in the cylinder, the cylinder being rotatable about its axis between a position in which the opening is disposed to receive sufficient material from the respective source to fill the measuring chamber and a position in which the opening is positioned to deliver the material in the measuring chamber to the shroud, the drive means being effective to rotate the cylinders of the metering means and of the mixing means in synchronism with one another.

3. Apparatus according to claim 1, in which the parts are so disposed that the materials can flow by gravity from the sources to the metering means, thence to the shroud and thence to the receiver.

4. Apparatus according to claim 1, including means for automatically energizing the drive means when the quantity of material in the receiver falls to a predetermined minimum and for automatically interrupting such energization when the said quantity rises to a predetermined maximum.

5. Apparatus according to claim 4, in which the receiver is mounted for tipping movement about a horizontal axis and is so asymmetrically shaped about the vertical plane through the axis that it will tip in one direction when the level of the material therein falls sufficiently and in the reverse direction when the level rises sufficiently, such tipping movements of the receiver being arranged to cause energization and de-energization respectively of the drive means.

6. A metering device for use in connection with apparatus for delivering to a receiver a mixture of predetermined portions of particulate materials, said metering device being located below a hopper, the metering device comprising a rotary hollow cylinder defined by a wall thickness, a measuring chamber formed in said cylinder and opening outwardly thereof to receive material from said hopper, means extending from said chamber into the interior of said cylinder and terminating in a first head, spring means normally biasing said rod means outwardly of said chamber and into said cylinder, a raceway, first means coacting with said raceway for urging said rod means against the bias of said spring a predetermined distance into said chamber as said cylinder rotates, whereby said rod means urges the contents of said cylinder outwardly thereof to eject said material from said chamber, and adjustable means coacting with said first means to establish the predetermined distance that said rod means moves into said chamber as said cylinder rotates, said adjustable means comprising a pivotable arm having a head mounted on one end thereof, said head riding on said raceway and screw means for adjusting the orientation of said arm.

7. The metering device of claim 6, including a flattened head attached to the end of the rod remote from said first head, said flattened head serving to eject the contents of said chamber.

8. The metering device of claim 6, including drive means to rotate said cylinder to bring the measuring chamber to top dead center position below the outlet of said cylinder, said drive means continuing to rotate said cylinder, such that the centrifugal force of rotation forces said rod head to rotate within said disc means against the force of said spring as the chamber is brought to bottom dead center position to eject the contents of said chamber.

* * * * *